US005141061A

United States Patent [19]

Henneuse

[11] Patent Number: 5,141,061

[45] Date of Patent: Aug. 25, 1992

[54] METHOD AND EQUIPMENT FOR DRILLING CONTROL BY VIBRATION ANALYSIS

[75] Inventor: Henry Henneuse, Pau, France

[73] Assignee: Societe Nationale Elf Aquitaine (Production), France

[21] Appl. No.: 613,639

[22] PCT Filed: Mar. 30, 1990

[86] PCT No.: PCT/FR90/00220

§ 371 Date: Nov. 30, 1990

§ 102(e) Date: Nov. 30, 1990

[87] PCT Pub. No.: WO90/12195

PCT Pub. Date: Oct. 18, 1990

[30] Foreign Application Priority Data

Mar. 31, 1989 [FR] France ..... 89 04234

[51] Int. Cl.[5] ..... E21B 47/00

[52] U.S. Cl. ..... 175/56; 73/39; 175/40

[58] Field of Search ..... 175/39, 40, 50, 56; 73/151, 659, 660

[56] References Cited

U.S. PATENT DOCUMENTS

| | | | |
|---|---|---|---|
| 3,520,375 | 7/1970 | Raynal et al. | 73/151 |
| 3,626,482 | 12/1971 | Quichaud et al. | 175/25 |
| 3,703,096 | 11/1972 | Vitter, Jr. et al. . | |
| 3,714,822 | 2/1973 | Lutz | 73/104 |
| 4,150,568 | 4/1979 | Berger et al. . | |
| 4,715,451 | 12/1987 | Bseisu et al. | 175/40 |
| 4,773,263 | 9/1988 | Lesage et al. . | |
| 4,928,521 | 5/1990 | Jardine | 175/39 |

FOREIGN PATENT DOCUMENTS

| | | |
|---|---|---|
| 1587350 | 3/1970 | France . |
| 96617 | 7/1973 | France . |

*Primary Examiner*—Thuy M. Bui

*Attorney, Agent, or Firm*—Bacon & Thomas

[57] ABSTRACT

Device for the auditory and/or visual representation of mechanical phenomena in the interaction between a drilling tool and rock being drilled, characterized by the fact that it includes a mechanism for picking up a vibratory signal representing the vibration of the tool at the cutting face using an accelerometric sensor at a specific point on the drilling stem and processing equipment (45, 31, 31) for filtering the signal in the frequency band of 10 to 200 Hz.

8 Claims, 4 Drawing Sheets

METHOD AND EQUIPMENT FOR DRILLING CONTROL BY VIBRATION ANALYSIS

The present invention concerns auditory and/or visual-display equipment of the drilling mechanics and its application in a drilling control method.

The French patent 1 587 350 discloses a procedure for measuring mechanical properties of rocks during drilling and equipment implementing said procedure.

Such a procedure allows ascertaining the lithologic properties of the rocks acted on by the drilling tool in that an accelerometer measures the rotational speed of the drill rod and in that deformation sensors determine signals corresponding to the vibration stresses applied to the rod. By analyzing these signals in analogue circuits a signal is obtained whereby this procedure reveals the lithologic properties of the rocks engaged by the tool.

It is further known from the application of an addition certificate 96 617 relating to the patent 1 590 327 how to measure rock lithologic properties during drilling, namely by selecting the components of a signal from a pressure pickup for the mud-column pressure and by selecting this signal in a frequency band centered on a frequency equal to the product of the tool rotation and the characteristic numbers of active tool elements.

However such equipment does not reveal information concerning the drilling status.

A first object of the invention is to propose equipment which after signal processing allows inferring information on such phenomena as the acceleration of the bit base or its jamming and then relaxation of the bit adhesion to the wall or lastly the failure to resume by the bit base.

This objective is achieved in that the auditory and/or visual-display equipment of the interaction mechanics between a drilling bit and the drilled rock comprises means in the form of an accelerometer to pick up at a specific point on the drilling stem a vibratory signal reflecting the tool vibration at its cutting surface and a signal filter in the frequency band of 10 to 200 Hz.

In another feature of the invention, the filtered signal is fed to an audio amplifier linked to a headphone.

In another feature of the invention, the filtered signal is transmitted to an electroluminescent-diode display of the bar-graph type.

In another feature of the invention, the filter or filter system consists of identical, second order high-pass, active filter selectively put in series with identical, second order low-pass active filters so as to provide the cutoff frequencies of the frequency band.

In another feature of the invention, the frequency band is 20 to 200 Hz for a bottom motor.

In another feature of the invention, the frequency band is 10 to 100 Hz for a surface motor.

Another object of the invention is simple equipment, easily moved and practical for a drilling site.

This objective is achieved in that the equipment comprises its own battery power supply for the pickup and the processing circuits.

A last object of the invention is equipment application in controlled drilling.

This objective is achieved in that the implementation consists in the following:

Filtering the accelerometer signal to preserve the spectrum in the 10 to 200 Hz frequency band, Listening to or displaying this filtered signal to deduce information on drilling control, Taking any necessary corrective steps on the basis of the information secured in the previous stage.

Other features and advantages of the present invention shall be elucidated below in the description in relation to the attached drawings.

Figure 1:
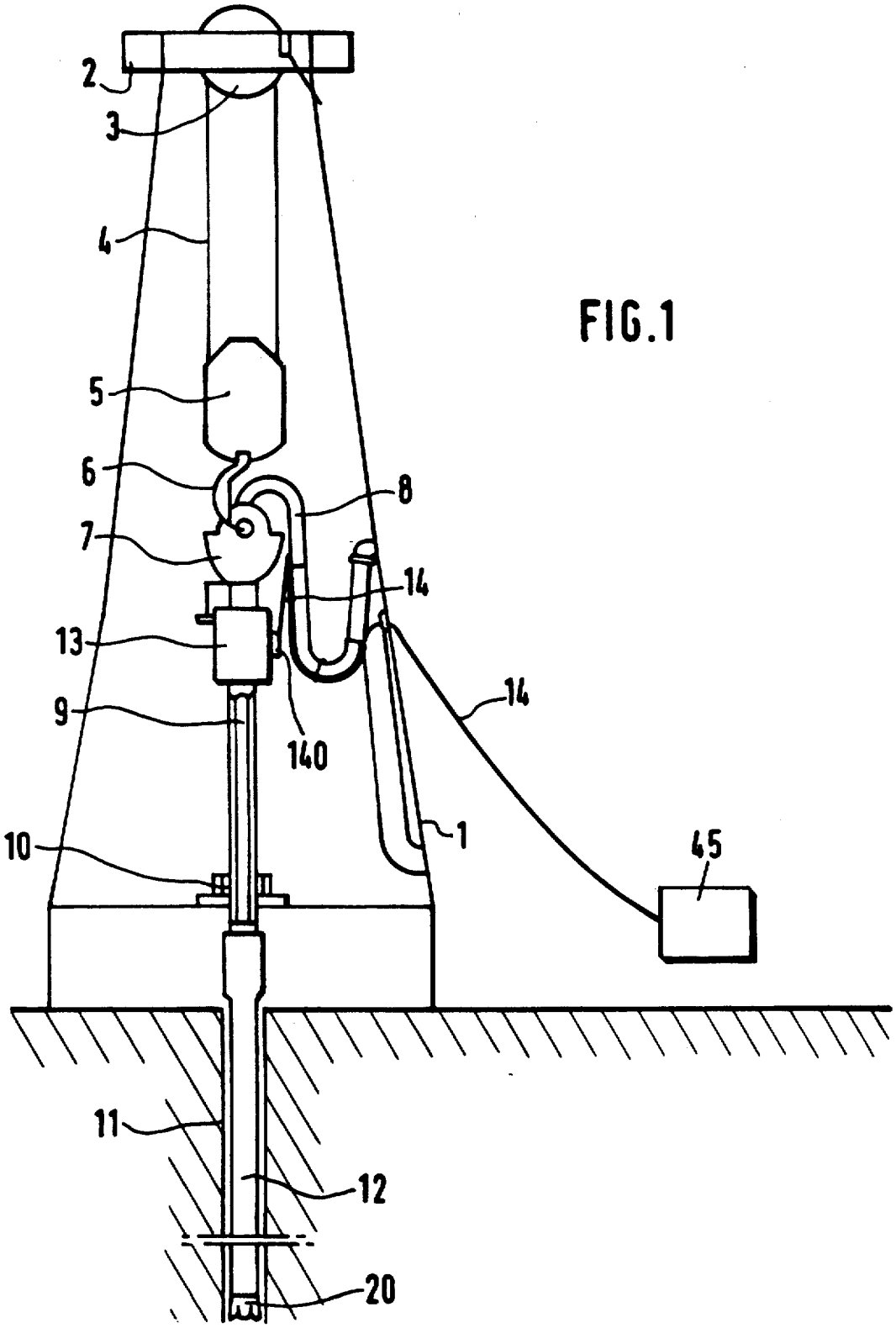
FIG. 1 is an overall schematic of the equipment mounted on drilling gear.

In FIG. 1, reference 1 denotes a drilling rig, 2 the upper part of this rig bearing the stationary pulleys 3. This set of pulleys 3 is linked by a set of cables 4 to the block bearing the movable pulleys 5. A hook 6 is affixed to the block 5 bearing the pulleys and supports an injection head 7. The upper part of this injection head 7 is stationary whereas the lower part is rotatable by means of a bearing. An injection hose 8 is connected on one hand to the injection head 7 and on the other hand to the set of mud pumps (omitted from the drawing).

The rotational drive rod 9 of the drilling stem is shown in square form and hereafter it will be merely called the kelly. This rod 9 is set in rotation by the rotary table 10 itself driven by an omitted motor.

Reference 11 schematically denotes a drilling hole entered by the drilling stem 12. This drilling stem 12 comprises a drilling bit 20 at its lower end.

A sensor system 13 is inserted between the injection head and the kelly. In a variation, this sensor system 13 may be affixed to the injection head 7. This sensor system 13 is connected by a cable 14 to the apparatus 45 processing electrical values.

Figure 2:
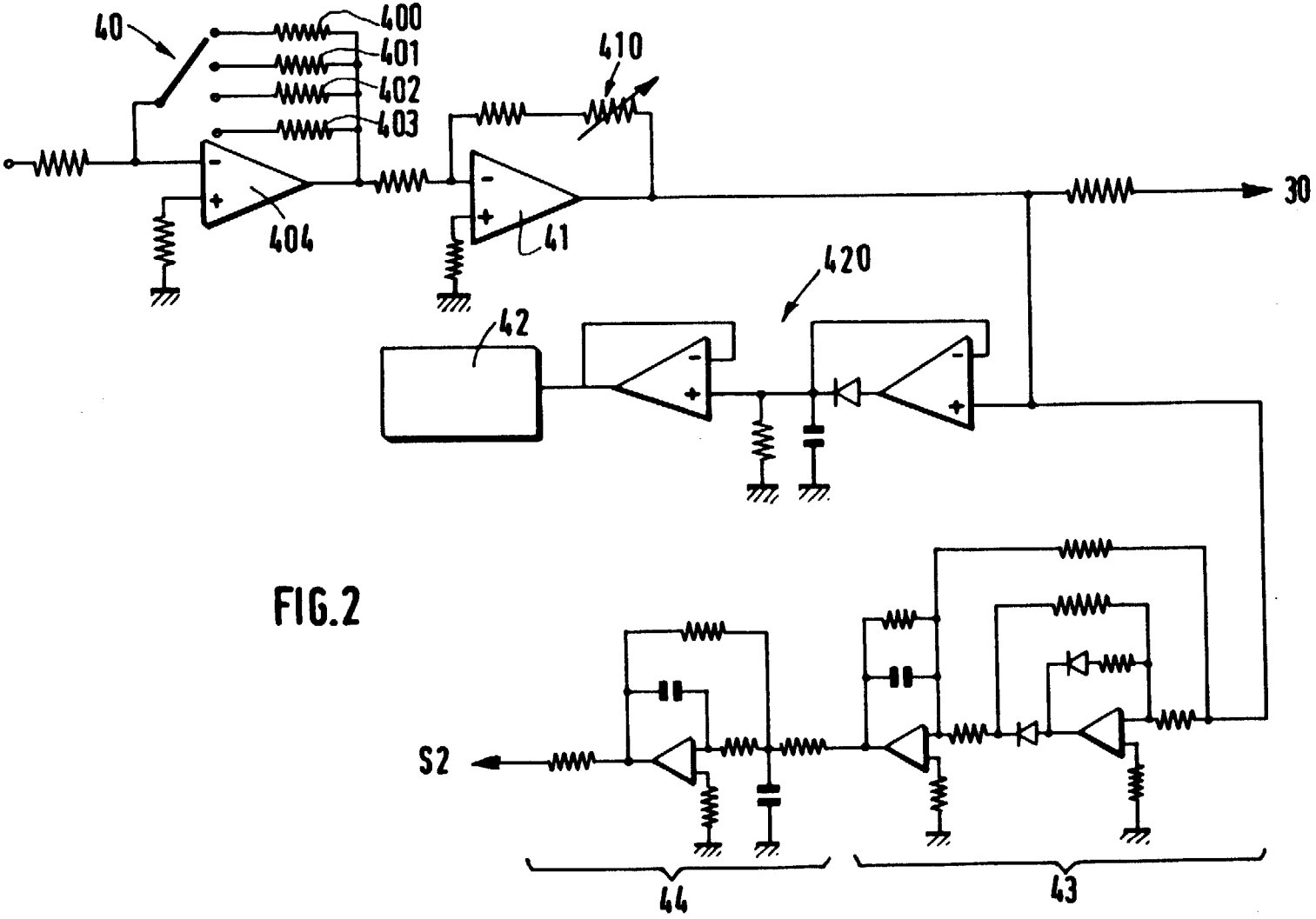
FIG. 2 is the block diagram of the electronic pre-amplifier.

The sensor consists of an accelerometer 140 converting the variations in acceleration of the rod end into an analogue electric signal. This analogue electric signal is processed by the processing equipment 45 of FIG. 4 consisting of an amplifier circuit shown in FIG. 2, of a filter circuit shown in FIG. 3, again of a pre-amplifier circuit 47, 470 for the filtered signal and of a conventional audio amplifier circuit 46 making it possible to listen to the signal so obtained.

The signal output from the pickup 140 is transmitted to the input of an amplifier of which the feedback resistance can be varied by a rotary switch 40, which selects resistors 400, 401, 402, 403, between output and input of the amplifier 404. The output of this amplifier 404 is followed by a second amplifier 41 comprising a variable resistor 410 in its feedback loop for fine control within the selected amplification range. The output signal of the amplifier 41 is transmitted on one hand to the input of the filter circuit of FIG. 3 and on the other hand through peak-detection circuit 420 to the display 42 of FIG. 4. Also, the output signal from the amplifier 41 passes through a rectifier circuit 43 and an integrating circuit 44 to the output S2 of the sensor. The signal arrives at the input 30 of a set of filters consisting of two second order, low-pass, active filter sections 31*a*, 31*b* followed by four second order, high-pass, active filter sections 32*a*, 32*b*, 32*c*, 32*d* and two second-order, low-pass, active filter sections 31*c*, 31*d*. These filters may be in series or partly or totally shorted depending on the settings of the knobs of the rotary switches 490, 491. The output 33 from the filter circuit is fed to the input of a second preamplifier circuit 47, 470, 48 of the same type as the one described in relation to FIG. 2. This second preamplifier circuit feeds its output signal from the amplifier output 470 to a conventional audio amplifier circuit 46 well known to the expert to provide to a listening post the signal from the invention's processing which allows monitoring the drilling status.

Each section of the second order, low-pass filter is constituted in the same way as the section 31*a* and comprises two series resistors 310, 311 at the minus input of a differential amplifier 313 of which the plus input is connected through a resistor 312 to ground.

The common point of the two resistors 310, 311 is connected on one hand by the capacitor 316 to ground and on the other hand by a resistor 315 to the output of the amplifier 313. The output of the amplifier 313 also is connected through a capacitor 314 to the minus input of this amplifier 313.

Each high-pass filter section is the same as section 32*a* and comprises two series capacitors 320, 321 connected to the minus input of a differential amplifier 323 of which the plus input is grounded through a resistor 322.

The common junction of the two capacitors 320, 321 is connected on one hand to ground through a resistor 326 and on the other hand through a capacitor 325 to the output of amplifier 323.

The output of amplifier 323 also is connected through a resistor 324 to the input of the amplifier 323.

The filter so composed of a sequence of sections 31*a* through 31*d* and 32*a* through 32*d* allows filtering the signal transmitted from the preamplifier to the 10 to 200 Hz frequency band depending on the settings of knobs of the rotary switches 490, 491.

Figure 3:
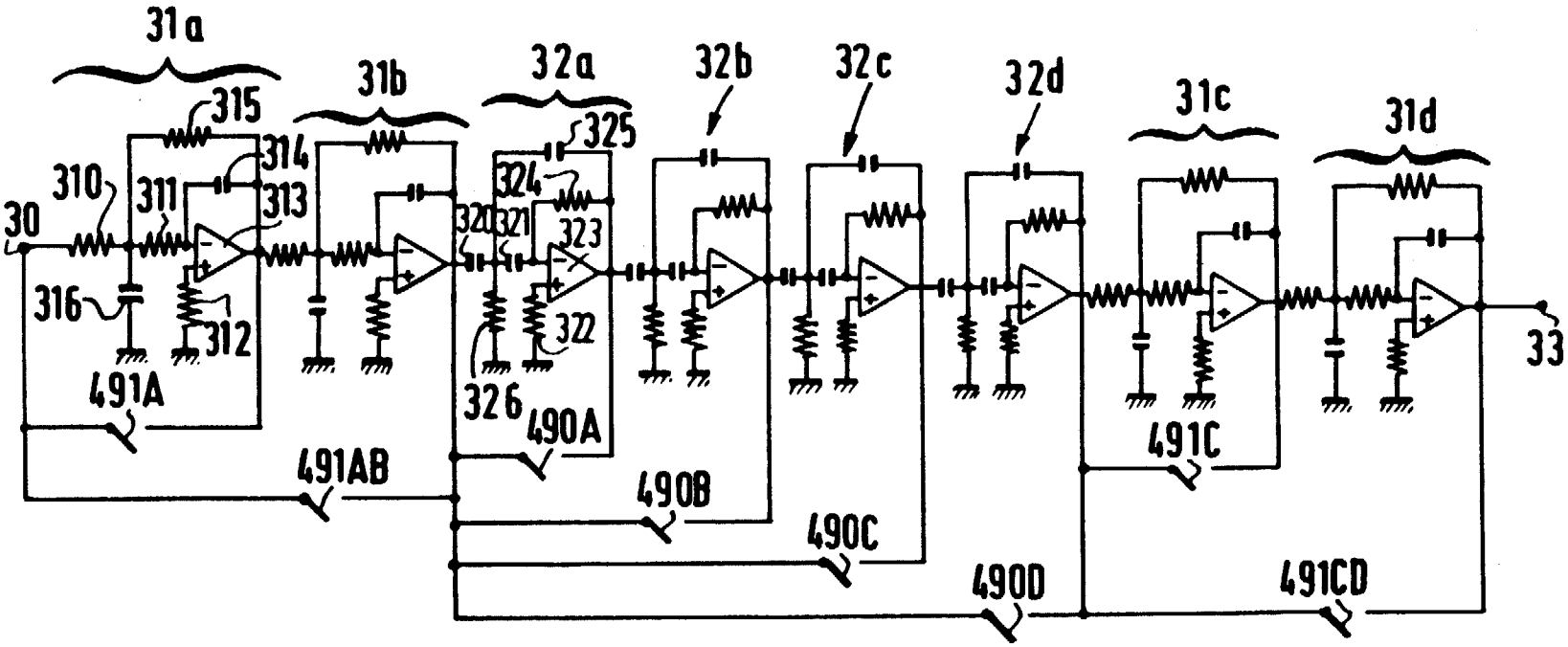
FIG. 3 is the circuit diagram of the invention's filtering system.
Figure 4:
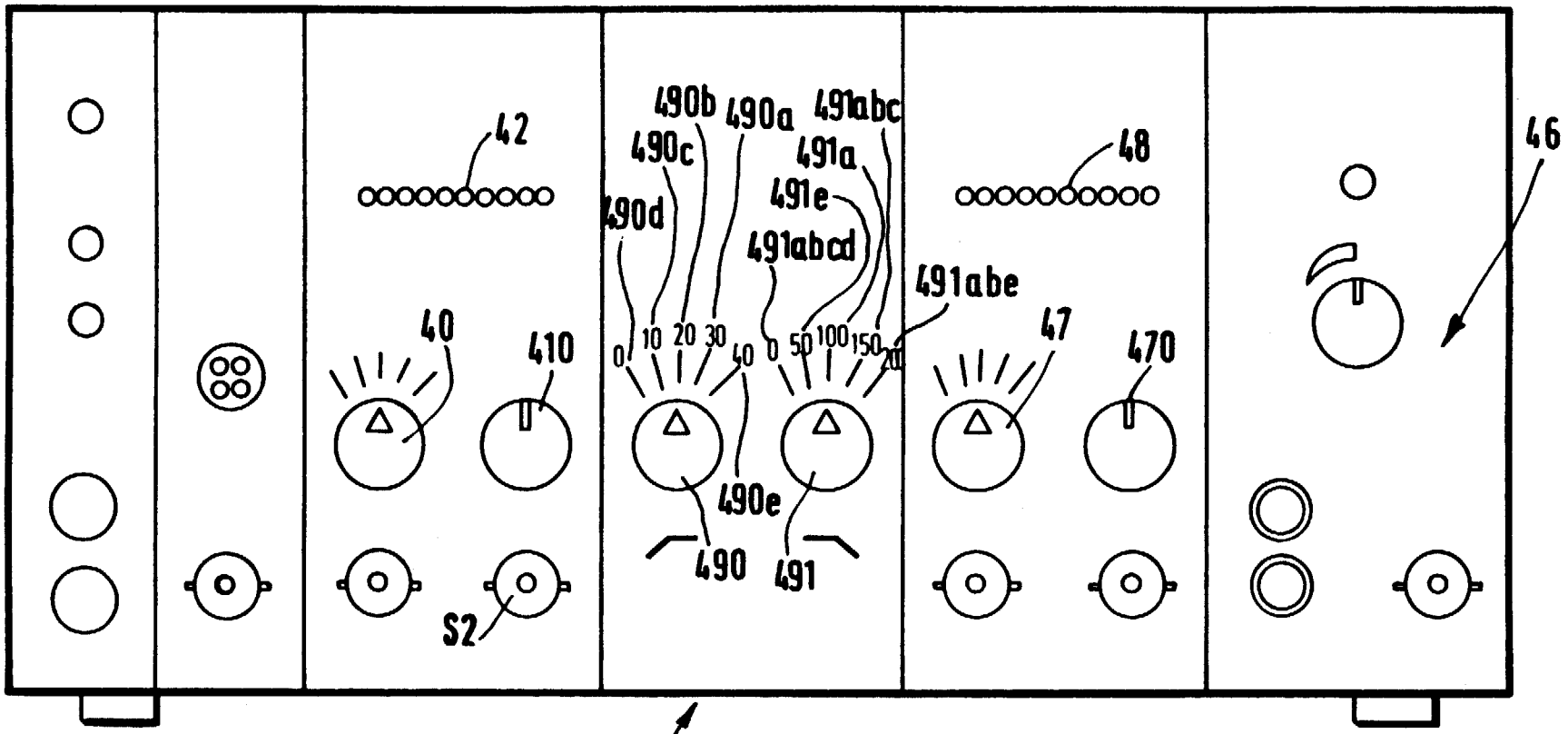
FIG. 4 is a front view of the equipment of the invention.

Accordingly when the knob 490 is set at 490*d* of FIG. 4, the corresponding switch 490D of FIG. 3 is closed and connects the input of section 32*a* to the output of section 32*d*, thereby shorting the high-pass sections 32*a* through 32*d*.

When the knob 490 is set to 490*c*, FIG. 4, the corresponding switch 490*c* is closed and connects the input of the section 32*a* to the output of the section 32*c*, shorting therefore the sections 32*a* through 32*c* and thereby keeping the high-pass filter 32*d* in the circuit. The resistive and capacitive elements of this filter 32*d* are designed to achieve frequency cutoff at 10 Hz.

When the knob 490 of FIG. 4 is set at 490*b* of FIG. 4, the corresponding switch 490B, FIG. 3 is closed and connects the input of the section 32*a* to the output of the section 32*b*, thereby shorting the sections 32*a* and 32*b*. The resistive and capacitive elements of the two series sections 32*c* and 32*d* are designed for a frequency cutoff at 20 Hz.

When the knob 490 is set at 490*a* in FIG. 4, the corresponding switch 490A connects the input of the section 32*a* to its output. The sections 32*b* and 32*d* are in series and the resistive and capacitive elements of the section 32*b* are designed so that the frequency cutoff of the set of three sections is 30 Hz.

Lastly, when the knob 490 is set at 490*e*, no contact is made and the four sections 32*a* through 32*d* are in series. The resistive and capacitive elements of the section 32*a* are designed so that the frequency cutoff of the four series sections is 40 Hz.

Similarly, when using the knob 491, the low-pass filter sections inserted into the filter circuit may be selected. When the knob 491 is set at 491*abc*, the sections 31*a* and 31*b* are shorted by the closed switch 491AB connecting the input of section 31*a* to the output of 31*b* and the section 31*c* also is shorted by the closed switch 491C connecting the input of 31*c* to its output. The resistive and capacitive elements of section 31*d* are designed for a frequency cutoff at 200 Hz.

When the knob 491 is set at 491*ab*, the sections 31*a* and 31*b* are shorted by the switch 491AB. The resistive and capacitive elements of the section 31*c* are designed so that the frequency cutoff of the unit formed by the two series sections 31*c* and 31*d* is at 150 Hz.

When the knob 491 is set at 491*a*, the switch 491A is closed and connects the input of the section 31*a* directly to its output. The elements of 31*b* are designed so that the filter composed of the series sections 31*b*, 31*c*, 31*d* have its frequency cutoff at 100 Hz.

When the knob 491 is set at 491*e*, no section from 31*a* through 31*d* is shorted and the frequency cutoff of this set of sections is 50 Hz.

Lastly when the knob 491 is set at 491*abcd*, the switches 491AB and 491CD are closed and the set of sections 31*a* through 31*d* is shorted.

The signal so filtered then is transmitted to a second preamplifier and to an audio amplifier for feeding an audio signal to a loudspeaker system. The listening or display device comprises an independent battery power supply. The signal fed into the 10 to 200 Hz frequency band allows auditory detection of any drilling anomaly. Surprisingly it was found that the signal so filtered eliminates all other drilling noises and solely retains the noises caused by the bit's contact with the bore. As a result an expert may take suitable corrective measures in relation to the observations that took place. In particular it is possible to ascertain whether the tool has resumed at the bottom or if it comprises asymmetry due to the loss of a tooth or if it has come upon an obstacle during its descent and did not reach the bottom of the borehole, or if jamming and then relaxation by bit adhesion to the wall took place.

As regards a motor at the bottom of the borehole, it was found that the 20–200 Hz frequency band provides optimal results. On the other hand the 10–100 Hz frequency band preferably shall be used for a surface motor. The frequency ranges are selected by means of the knobs 490, 491 of FIG. 4.

Obviously the spirit of the invention shall be the same even if the audio amplifier circuit at the output of the second preamplifier is replaced by a bar-graph electroluminescent diode system or if the display of microcomputer monitor is replaced by bar-graph software.

Other modifications within the knowledge of the expert also are within the scope of the present invention.

I claim:

1. Auditory and/or visual-display apparatus for the mechanical interaction between a drilling bit and the drilled rock, comprising an accelerometer located at a point on a drilling stem for picking up a vibratory signal representing the bit vibration at the cutting surface; means for filtering the signal within a frequency band of 10 to 200 Hz; and means for amplifying the filtered signal so that it is audible to an operator at a listening post.

2. The apparatus as defined in claim 1 wherein the frequency band of the filtering means is 20 to 200 Hz for a bottom motor.

3. The apparatus as defined in claim 1 wherein the frequency band of the filtering means is 10 to 100 Hz for a surface motor.

4. The apparatus as defined in claim 1, further comprising a bargraph electroluminescent diode display to which the filter signal is transmitted.

5. The apparatus as defined in claim 1, further comprising an independent battery power supply and processing circuits.

6. The apparatus as defined in claim 1, wherein the filtering means consist of identical, second order, high-pass, active filter sections selectively placed in series with identical, second order, low-pass, active filter sections to constitute the frequency-band cutoffs.

7. The apparatus as defined in claim 6, wherein the high-pass and the low-pass filter sections are selectively put in series by a rotary switch.

8. A method for controlling drilling, comprising:

filtering the output signal of an accelerometer located at a point on a drilling stem picking up a vibratory signal representing the bit vibration at the cutting surface and keeping the spectrum in the 10 to 200 Hz frequency band, listening to or displaying this filtered signal for information on drilling control, take any necessary corrective step on the basis of the information acquired in the previous stage.

* * * * *